United States Patent [19]

Jones

[11] 4,082,071

[45] Apr. 4, 1978

[54] ENGINE VENT VAPOR FILTER AND METHOD OF CONSTRUCTING SAME

[76] Inventor: Oscar F. Jones, P.O. Box 495, Salina, Okla. 74365

[21] Appl. No.: 659,694

[22] Filed: Feb. 20, 1976

[51] Int. Cl.[2] ..... F02B 33/00; B23P 15/16

[52] U.S. Cl. ..... 123/119 B; 29/163.5 F; 55/DIG. 5; 55/DIG. 19

[58] Field of Search ..... 29/163.5 F; 55/379, 55/486, 487, 488, 498, 510, DIG. 5, DIG. 19, 500, 502; 123/119 B

[56] References Cited

U.S. PATENT DOCUMENTS

| | | | |
|---|---|---|---|
| 2,830,359 | 4/1958 | Reinshagen | 29/163.5 F |
| 2,883,056 | 4/1959 | Mullen | 55/510 |
| 3,026,609 | 3/1962 | Bryan | 29/163.5 F |
| 3,241,537 | 3/1966 | Jones | 123/119 B |
| 3,353,457 | 11/1967 | Whittingham et al. | 55/DIG. 5 |

*Primary Examiner*—Carlton R. Croyle

*Assistant Examiner*—L. J. Casaregola

*Attorney, Agent, or Firm*—Head, Johnson & Chafin

[57] ABSTRACT

A vapor filter cartridge for use in a volumetrically controlled crankcase ventilation system, which utilizes a cylindrical frame of expanded metal surrounded by a vapor filter cloth. The bottom end of the cylinder is sealed by a shallow cup type closure, having a central opening. The closure is attached and sealed and attached to the cylindrical wall by means of a thermosetting rubber-like material. A support flange is provided of molded thermosetting rubber-like material which is molded to the second end of the cylindrical frame. The flange serves as a structural member to support the cartridge. Also, because of its compliant nature, it serves as a sealing gasket between the support and cover structure of the ventilation device, and the top edge of a jar which is used to catch the liquid and larger particles which are carried into the jar from the crankcase space of the engine.

4 Claims, 7 Drawing Figures

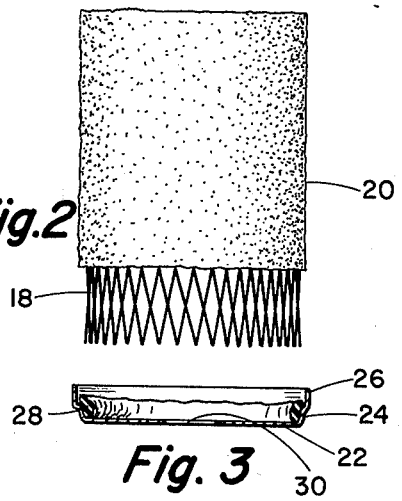
Fig.2
Fig. 3
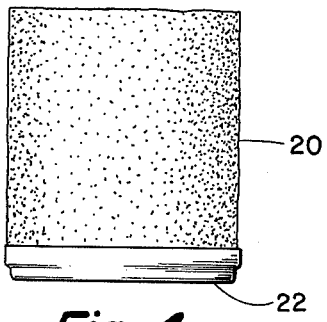
Fig. 4
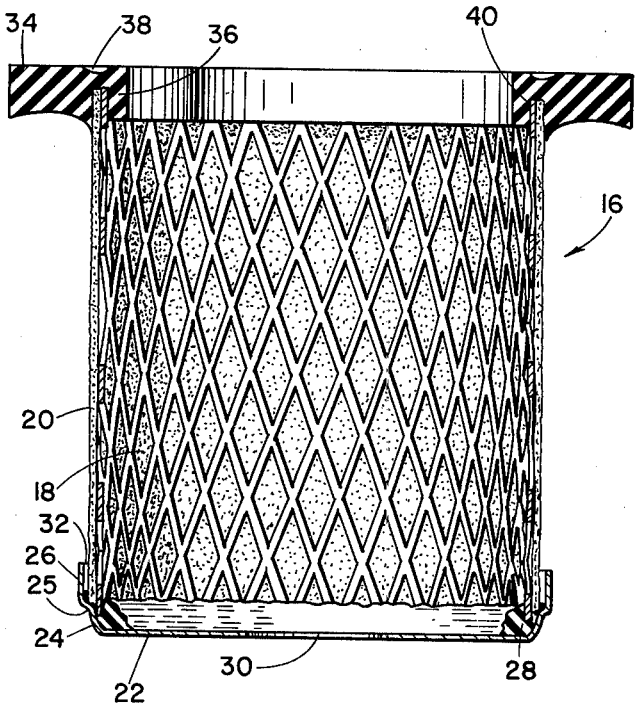
Fig. 1
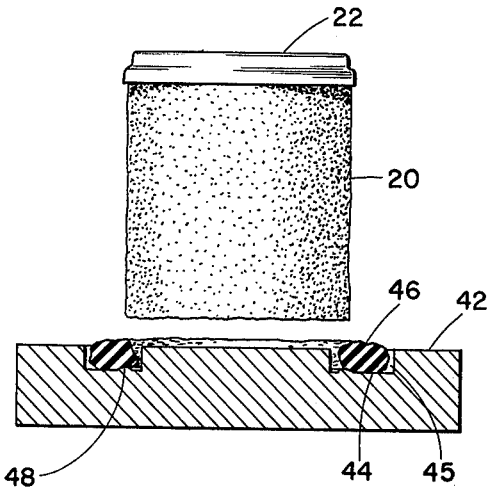
Fig. 5
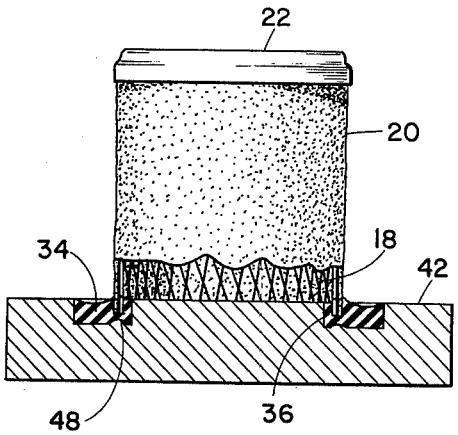
Fig. 6

ENGINE VENT VAPOR FILTER AND METHOD OF CONSTRUCTING SAME

CROSS-REFERENCES TO RELATED PATENT

This application is related to the U.S. Pat. No. 3,241,537 entitled: Volumetric Controlled Crankcase Ventilation System, of the same inventor O. F. Jones, which issued Mar. 22, 1966. U.S. Pat. No. 3,241,537 is entered into this application by reference.

BACKGROUND OF THE INVENTION

This invention lies in the field of internal combustion engines. More particularly, it is part of a crankcase ventilation system for internal combustion engines. Still more particularly it concerns the improved construction of a vapor filter cartridge which can be used in a volumetrically controlled crankcase ventilation system, such as that which is described in U.S. Pat. No. 3,241,537.

In the prior art, various means have been devised for utilizing the combustible vapors which normally accumulate in the crankcase space of an internal combustion engine. These devices carry these combustible vapors to the intake manifold of the engine so as to minimize the flow of these hydrocarbons into the atmosphere, and also to conserve energy.

One such device which has been utilized for this purpose is the volumetrically controlled crankcase ventilation system to Oscar F. Jones which is illustrated and described in the U.S. Pat. No. 3,241,537. In this device, the crankcase vapors removed from the crankcase are first directed downward into a jar for the collection of the larger solid particles and liquid droplets, etc. The vapors are then reversed in direction, and are carried upward through perforations in a plate which divides the jar into two parts. The upper portion in the upper part of the jar contains a vapor filter cartridge. The bottom portion of the jar collects the waste products. The crankcase vapors then flow through the wall of the vapor filter cartridge, which comprises a sheet of metal perforated with openings and rolled in the shape of a cylinder, and about which has been wrapped a vapor filter cloth. The bottom end of the cylinder is covered by a plate which has a central opening through which the crankcase vapors pass by means of a tube, to the space below the plate. The upper end of the cartridge has a flange which is clamped in conjunction with a pair of gaskets, one above and one below the flange, so that the top support and cover structure can be clamped through a gasket to a flange of the vapor filter cartridge, and through a second gasket to the top edge of the containing jar or trap.

It is a primary object of this invention to provide an improved construction of the vapor filter cartridge so as to eliminate the complex sealing structure of a flange and two gaskets, to seal the three parts together at the top of the jar, or trap.

It is another important object of this invention to provide a type of construction of the vapor filter cartridge to simplify the construction and minimize the number of parts required.

It is a still further object of this invention to provide a type of vapor filter cartridge in which the semi-rigid wall construction of the cartridge is maintained but with a very large ratio of open area to support area, so that substantially all of the filter cloth which surrounds the metal frame is effective as a filter, and therefore the cartridge can serve for a maximum period of time for a given size of and surface area of the cartridge.

SUMMARY OF THE INVENTION

Thee and other objects are realized, and the limitations of the prior art are overcome in this invention, by using as the support structure for the vapor filter cartridge a sheet of expanded metal, which is rolled in the form of a cylinder with the edges slightly overlapping. This replaces the previously used material which was a thin sheet of perforated steel. The vapor filter cloth is wrapped around the frame of expanded metal, and the edges also are overlapped.

The closure at the bottom of the cartridge is a sheet of metal formed as a shallow cup. A thin bead of thermosetting rubber-like, compliant material is placed in the corner of the shallow cup, and the previously prepared cylindrical filter element of perforated metal and cloth is set into the cup in the vicinity of the thermosetting material. The material is in the form of a liquid which wets both the shallow cup and the filter element. The assembly is then passed through an infrared heater where the thermosetting material is hardened, and firmly grasps and seals the cylindrical metal and cloth element, to the base closure.

The other end of the filter element is then inverted into a mold cavity comprising a shallow circular channel of the proper depth and diameter, which is partially filled with the liquid form of a thermosetting rubber-like material. The liquid again attaches itself to the metal and cloth of the frame of the filter cartridge. The assembly is then passed through an infrared heater to provide a temperature sufficient to polymerize and harden the composition. Thereafter, when the device cools the rubber-like material is formed into a transverse flange that binds together the cloth and metal screen, serves as a handle, and also serves as a sealing medium when assembled between the cover structure and the jar or trap.

BRIEF DESCRIPTION OF THE DRAWINGS

These and other objects and advantages of this invention and a better understanding of the principles and details of the invention will be evident from the following description, taken in conjunction with the appended drawings, in which:

FIG. 1 is a view in cross-section of the completed product of this invention.

FIGS. 2 and 3 illustrate the parts of the apparatus for the assembly of the cylindrical frame, filter cloth, and the bottom closure.

FIG. 4 represents the completed seal and attachment of the frame and filter and bottom plate.

FIG. 5 illustrates in partial cross-section the formation of the supporting flange to the filter cartridge.

FIG. 6 illustrates a second step in the preparation of the flange of the filter cartridge.

Referring now to the drawings and in particular to FIG. 7, there is shown an assembly view in perspective and partial cross-section, of the crankcase ventilation system, of which this invention of an improved filter cartridge, is a part. FIG. 7 is based upon FIG. 6 of U.S. Pat. No. 3,241,537 which is made a part of this application by reference.

Figure 7:
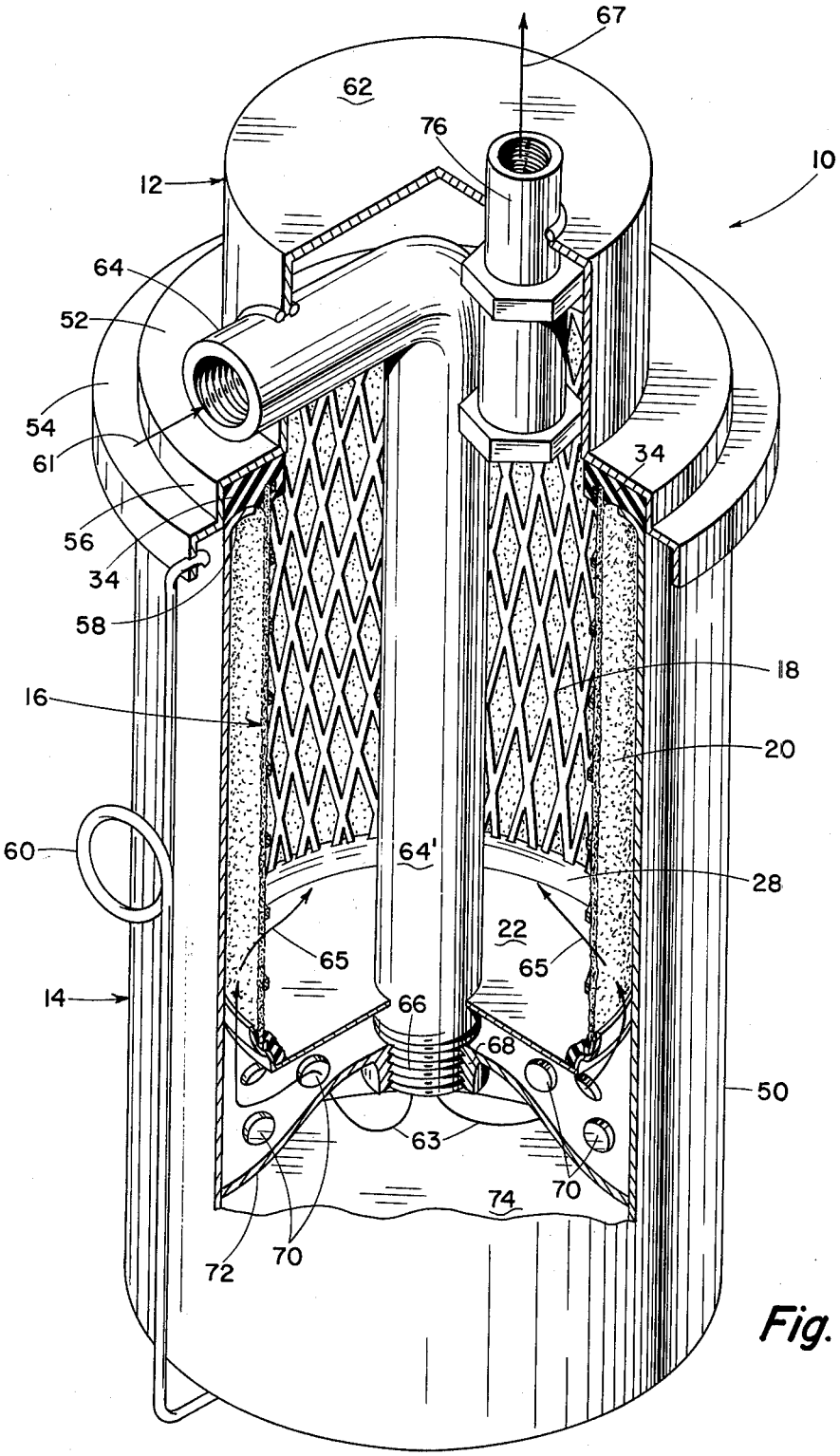
FIG. 7 illustrates an assembly in partial cross-section of the crankcase ventilation system of which this filter cartridge is a part.

The ventilator system of FIG. 7 is indicated generally by the numeral 10. It comprises a support plate and cover, indicated generally by the numeral 12. This includes an inverted cup shaped portion 62 with a flange 52 and a second flange 54. The device is supported by means of two threaded pipes 76 and 64. The pipe 64 leads to a conduit which brings crankcase vapors, according to arrow 61, into the pipe 65, down axially in the portion 64' and out through the bottom in the form of arrows 63. The flow of crankcase vapors reverses in direction in accordance with the arrow 63 and then passes upward through one or more of the openings 70 in a plate 72 which substantially seals of the cross-section of the container, jar, on trap 50, indicated generally by the numeral 14.

In the reversal from the downward flow of arrows 63, to the upward flow around the outside of, and through the wall of the filter cartridge indicated generally by the numeral 16, the crankcase vapors will drop into the jar 50 any large solid particles or droplets of liquid etc. that may be entrained in the vapors as they flow downward through the pipe 64'. Within the vapors flowing according to arrows 63 and 65 are entrained other tiny droplets and particles which are normally too small to be thrown out by the reversal of the flow of the gas. However these are retained by the filter cloth 20 which is wrapped around the cylindrical frame 18, which is made of expanded metal or other perforated sheets. The filter cloth retains all of the particulate matter and tiny droplets, permitting the hydrocarbon vapors to pass through to the interior of the filter cartridge and upward to the bottom opening of the valve 76, which controls the flow of gas through the device, and out through the top opening 76 in accordance with arrow 67. The flow 67 out the top goes to the intake manifold of the internal combustion engine.

For further detail of the construction and operation of the device 10, reference is made to U.S. Pat. No. 3,241,537, which is part of this application. The purpose of entering this drawing FIG. 7, is to show that the jar or trap 50 must be sealed to the cover plate flange 52 of the support structure 12, so that there is no leakage of air through the contact between the jar and the cover.

As shown in the patent, the top of the filter cartridge was constructed with a transverse metal flange which was placed between the flange 52 and the top 58 of the jar, and had to be sealed by two planar gaskets one above and one below, since there were three mutually sealable surfaces which had to be completely sealed.

In this invention an improved model of the filter cartridge is described and claimed which utilized principally a flange 34 made of complaint sealing material, so that while supporting the cartridge inside of the jar 50, it also serves as a sealing sheet or ring 34 between the top 58 of the jar, and flange 52 of the cover 12.

Referring now to FIG. 1 there is shown in cross-section one embodiment of the device of this invention. It comprises a cylindrical frame or support structure for the filter cartridge which comprises a sheet of perforated metal, or still more preferably a sheet of expanded metal 18, which is rolled and formed into a cylindrical form, with an overlap between the two matching edges. This open cylindrical frame is covered with a sheet 20 of filter cloth, which can be made of any suitable fibrous material but for which purpose the commercial material known in the trade as *Needlepoint Orlon* is very well suited. The filter cloth 20 is wrapped around the frame 18 and overlaps so as to seal the openings through the frame.

There is a bottom plate 22 which is formed in the shape of a shallow pan or cup having a rim 26. It also has a central opening 30 which is of the proper size to seal around the outer surface of the downgoing tube 64' of FIG. 7. The bottom plate 22 is sealed and attached to the cylindrical frame and filter cloth as shown in FIGS. 2 and 3. FIG. 2 shows the expanded metal frame 18 and the filter cloth wrapping 20. In the closure plate 22, there is deposited in the corner of the pan a ring of suitable material 28 for the purpose of sealing and attaching the bottom plate 22 to the frame 18.

There are a number of suitable materials for this purpose. However, one such material which has been found particularly advantageous is a rubber-like composition which at low temperature is in the form of a viscous liquid, which can be placed 28 in the corner of the plate 22 as shown in FIG. 3. The frame with cloth covering is then positioned in the closure plate as shown in FIG. 1. The liquid sealant 28 then wets and intimately contacts the metal and cloth of the filter cartridge, as it does also wet and attach to the pan 22. The assembly of FIGS. 2 and 3 which appear in the form of FIG. 4, is then passed through an infrared heating oven which heats the pan and filter frame and cloth to a temperature suitable to polymerize and harden the liquid, which then forms a substantially rigid, through partially deformable, rubber-like material, which closely adheres to the pan 22 and the frame and cloth, forming a good mechanical attachment as well as sealing all openings between a pan and the frame.

As shown in FIG. 1, there is at the upper end of the cartridge a transverse flange 34 which is attached to the frame of metal and cloth. This flange is formed about the end of the frame by use of a metal plate having a mold cavity 44 comprising a circular trough or channel into which is poured a selected amount of the liquid thermal hardening compound 46. The channel 44 is of such a radial dimension that a part of the sealant 46 is positioned inside of the metal frame and the larger portion of it is positioned outside of the frame. The frame and cloth dip into this liquid which thoroughly wets the cloth and the frame but does not wet the mold material 42. After the parts are positioned as in FIG. 5 and FIG. 6, the assembly is again passed through the infrared heating furnace of the proper temperature, where the ring of material 46 is thermally converted to a semi-rigid, rubber-like material which is firmly attached to the metal frame and the cloth, and which is strong enough to fully support the cartridge. The flange 34 is of a hardness or flexibility which is sufficiently soft, so that when clamped between the jar and the top plate as in FIG. 7, completely seals the joint between the jar and the cover plate as well as sealably supporting the filter cartridge.

As shown in FIGS. 1 and 3, the closure plate 22 is preferably made with a flange formed in two parts, a part 24 of a diameter less than that of the frame 18 and a part 26 which is made of a larger diameter than the frame 18, so that there is a sort of step or shoulder 25 which supports the frame slightly above the bottom plane of the closure 22. There is a space 32 on the ouside of the frame so that the sealant material 28 will form outside of the cloth, and seal it to the inner wall of the cup surface 26.

Similarly at the top flange a portion of the material 36 is sealed on the inside to the frame so as to thoroughly attach the frame and cloth to the flange.

As shown in FIGS. 5, 6 and 1, by design of the shallow circular trough or channel 44, a projection 48 can be left, which creates in the molded flange a trough 38 which helps to seal the flange 34 against the contacting surface of the flange 52 of the top structure 12. It is also possible, although not shown, that by proper shaping of the trough 44 a semi-circular trough corresponding to one-half of the cross-section of an "O" ring could be cut into the bottom surface of the trough 44 so that when the flange is molded it will have a semi-circular protrusion corresponding to the part of an "O" ring, to further improve the seal between the flange 34 and the top plate 12 of the ventilating system.

In the U.S. Pat. No. 3,241,537, the filter cartridge is shown with a sheet metal base rolled and formed into a cylinder. The sheet metal is perforated with a plurality of circular openings. In order to provide sufficient rigidity so that the sheet can be formed into a cylinder, it is difficult to get more than 50% open area to the perforated sheet. It is also very expensive to form a perforated sheet in this way. It have found that a sheet of expanded metal, when rolled into the form of a cylinder, is just as rigid as the perforated sheet or more so, and may have an area of openings, which approximates 80 to 90% of the total area of the sheet.

Because the size of the device indicated in FIG. 7 must be limited to the space available within the housing of an internal combustion engine, such as for engine for an automobile, there is limited volume, or limited vertical size to the filter cartridge. Therefore, in order to provide a maximum surface of filter cloth that can be fully utilized, the larger surface area of the open portions of the metal frame the better. The construction of the metal frame by the use of expanded metal utilizes a greatly increased proportion of the area of the cloth for filtering purposes, and is much to be preferred over the use of a punched or perforated metal sheet.

What has been described is an improved form of a replaceable filter cartridge, for use in a device for filtering crankcase vapors drawn from the crankcase of an internal combustion engine, and after filtering passed to the intake manifold of the engine. The design of the filter cartridge is such as to provide:

a. a cartridge of maximum filtering capability based on the fact that for the size of the frame there is a maximum of open space for the passage of gas, and for the recover of impurities on the cloth filter.

b. a flange for support and attachment of the filter cartridge to the filtering system, which instead of being metal which requires the addition of two planar sealing gaskets, is made of a compressible rubber-like material which not only serves to mechanically support the filter cartridge, but also serves as a sealable gasket material between the filter jar or trap, and the cover plate.

c. the same thermosetting compound that forms the flange is used as a sealing material between the frame, cloth, and the bottom plate of the filter cartridge.

A type of sealing material 28, 46 that can be used advantageously in this invention, is that known as CO-FLEX PLATISOL #14 sold by Cope Plastics Inc., Oklahoma City, Okla.

While the invention has been described with a certain degree of particularity, it is manifest that many changes may be made in the details of construction and the arrangement of components. It is understood that the invention is not to be limited to the specific embodiment set forth herein by way of exemplifying the invention, but the invention is to be limited only by the scope of the attached claim or claims, including the full range of equivalency to which element or step thereof is entitled.

What is claimed is:

1. In a volumetrically controlled cranckcase ventilation system for internal combustion engines, including a support and cover structure, a container for collecting liquid and solid particles which is sealed at its open end to said support and cover structure, a filter cartridge for retaining small particles, and a control valve, the method of construction of said filter cartridge comprising the steps of:

a. rolling a sheet of perforated metal to form a relatively rigid cylindrical frame open at top and bottom;

b. wrapping an outer layer of filter cloth around said frame, and coextensive therewith;

c. attaching and sealing to one end of said frame and filter cloth a closure plate comprising a shallow dish; comprising the sub-steps of;

1. placing in the corner of said closure plate a selected amount of thermosetting liquid;
2. placing said frame and filter cloth in said closure plate so that said liquid will wet said frame and filter cloth; and
3. heating the assembly of said frame and filter cloth and closure plate to cause said thermosetting liquid to set;

d. forming a molded support and sealing flange at the second end of said frame, of thermosetting material, so as to seal and surround the ends of said frame and filter cloth, and to form a substantially rigid flange; whereby said flange is adapted to be clamped and sealed to said support and cover structure to support said cartridge; comprising the sub steps of;

1. forming a mold cavity of outer diameter greatr than that of said frame and filter cloth;
2. inserting into said cavity a selected volume of a selected liquid thermosetting compound;
3. placing the second end of said frame and filter cloth into said liquid in said cavity; and
4. heating the assembly to cause said thermosetting liquid to set;

whereby said molded material not only seals the end of said frame and filter cloth, but forms a flange, which is the structural means to support and seal said filter cartridge to said support and cover structure.

2. The method as in claim 1 in which said frame comprises a sheet of expanded metal rolled into a cylinder, with overlapping edges.

3. The method as in claim 1 in which said filter cloth comprises a sheet of unwoven fibrous material with overlapping edges.

4. The method as in claim 1 in which said flange is molded of thermosetting rubberlike material.

* * * * *